United States Patent [19]

Peterson

[11] 4,010,552

[45] Mar. 8, 1977

[54] GRAIN DRIER

[76] Inventor: Emery J. Peterson, Clifton, Kans. 66937

[22] Filed: Mar. 17, 1976

[21] Appl. No.: 667,489

[52] U.S. Cl. ..... 34/179; 34/180; 34/182; 432/128; 34/171

[51] Int. Cl.[2] ..... F26B 11/12

[58] Field of Search ..... 34/187, 171, 179–183; 432/128, 130, 132, 139, 140, 153, 154, 163

[56] References Cited

UNITED STATES PATENTS

| | | | |
|---|---|---|---|
| 1,459,923 | 6/1923 | Nagel | 432/139 |
| 2,374,425 | 4/1945 | De Weerth | 34/182 |
| 3,096,165 | 7/1963 | Lane | 34/183 |
| 3,166,386 | 1/1965 | Maksymec | 34/181 |
| 3,512,765 | 5/1968 | Der Lely | 432/154 |

*Primary Examiner*—John J. Camby
*Assistant Examiner*—Henry C. Yuen
*Attorney, Agent, or Firm*—John H. Widdowson; Edwin H. Crabtree

[57] ABSTRACT

A wheel mounted grain drier for towing behind a farm vehicle or the like. The grain drier having a pair of horizontally mounted augers with perforated hollow auger shafts. In the drier the grain is conveyed along the length of cylindrical chambers by the augers as a gas fired blower vents hot air along the length of the hollow auger shafts and out the perforations thereby drying the grain as it is conveyed.

12 Claims. 8 Drawing Figures

GRAIN DRIER

BACKGROUND OF THE INVENTION

This invention relates generally to the drying of farm crops and more particularly but not by way of limitation to a wheel mounted grain drier.

Heretofore there have been various types of grain driers using augers for conveying the grain through the drying machine as it is dried. In some instances the grain driers have used blowers for circulating hot air through perforated hollow shafts in the augers for drying the grain.

None of the prior art grain driers and crop drying conditioners disclose the novel structure and advantages of the subject invention as herein disclosed.

SUMMARY OF THE INVENTION

The subject grain drier is wheel mounted for mobility and convenience in drying crops in the field without having to transport the harvested crop to a stationary drying system.

The invention is easily adaptable for pulling behind various types of farm vehicles and can be attached to the power takeoff system of the towing vehicle for operating the drier.

The grain drier is designed to receive large volumes of grain and rapidly and efficiently dry the grain prior to transferring the grain to a waiting storage vehicle parked beside the grain drier. The drier is designed to operate at different speeds so that the time required to dry grain having different moisture contents can be adjusted accordingly.

The subject invention includes an elongated drier housing mounted on a wheeled vehicle frame. Adjacent cylindrical chambers are horizontally formed in the housing for receiving augers therein. The augers include hollow shafts with perforations therein. The hollow shafts are vented to a blower mounted on the housing wherein the blower circulates hot air through the hollow shafts and out perforations in the sides of the shaft for drying the grain as it is conveyed along the length of the cylindrical chambers by the augers. The wet grain is received into one end of a first cylindrical chamber. The grain is conveyed the length of the first chamber as it is being dried by the hot air passing through the perforations in the auger shaft. At the opposite end of the first chamber the grain is discharged into the adjacent second chamber and conveyed in an opposite direction along the length of the second chamber. At the opposite end of the second chamber the drying process in completed and the dried grain is discharged into a transfer tube having a transfer tube auger mounted therein for discharging the grain away from the grain drier.

The advantages and objects of the invention will become evident from the following detailed description when read in conjunction with the accompanying drawings which illustrate the perferred embodiments of the invention.

BRIEF DESCRIPTION OF THE DRAWINGS

FIG. 5 is a rear view of the grain drier.

DETAILED DESCRIPTION OF THE DRAWINGS

Figure 1:
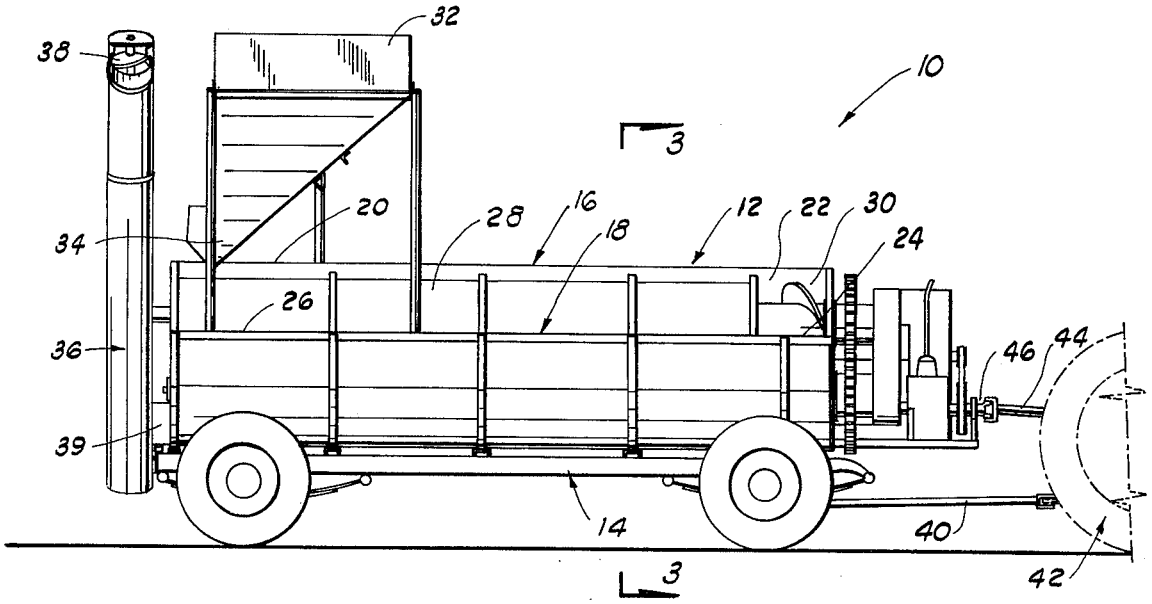
FIG. 1 is a side view of the grain drier.

In FIG. 1 the grain drier is designated by general reference character 10. The drier 10 includes a drier housing 12 mounted on a wheeled vehicle frame 14. A first elongated horizontal cylindrical chamber 16 is disposed above and adjacent to a second elongated horizontal cylindrical chamber 18. The first chamber 16 includes a first end portion 20 and a second end portion 22. The second chamber 18 includes a first end portion 24 and a second end portion 26. The first chamber 16 and second chamber 18 are separated by a divider 28, except for an opening 30 between the second end portion 22 of the first chamber 16 and the first end portion 24 of the second chamber 18.

A grain hopper 32 is mounted on the housing 12. An outlet 34 in the bottom of the hopper 32 is disposed above the first end portion 20 of the chamber 16 for feeding the grain to be dried into the drier 10.

A transfer tube 36 having a transfer tube auger 38 mounted therein is pivotally attached to the housing 12 and communicably connected by a transfer chamber 39 to the second end portion 26 of the second chamber 18 for receiving the dried grain therefrom and discharging the grain into a storage vehicle parked beside the drier 10 or into any other storage means.

The wheeled frame 14 includes a tow bar 40 for hitching to a farm vehicle 42 or the like. The vehicle 42 includes a power takeoff assembly 44 for attaching to and driving a drive shaft 46 which is rotatably mounted along the length of the housing 12 and below the first chamber 16.

Figure 2:
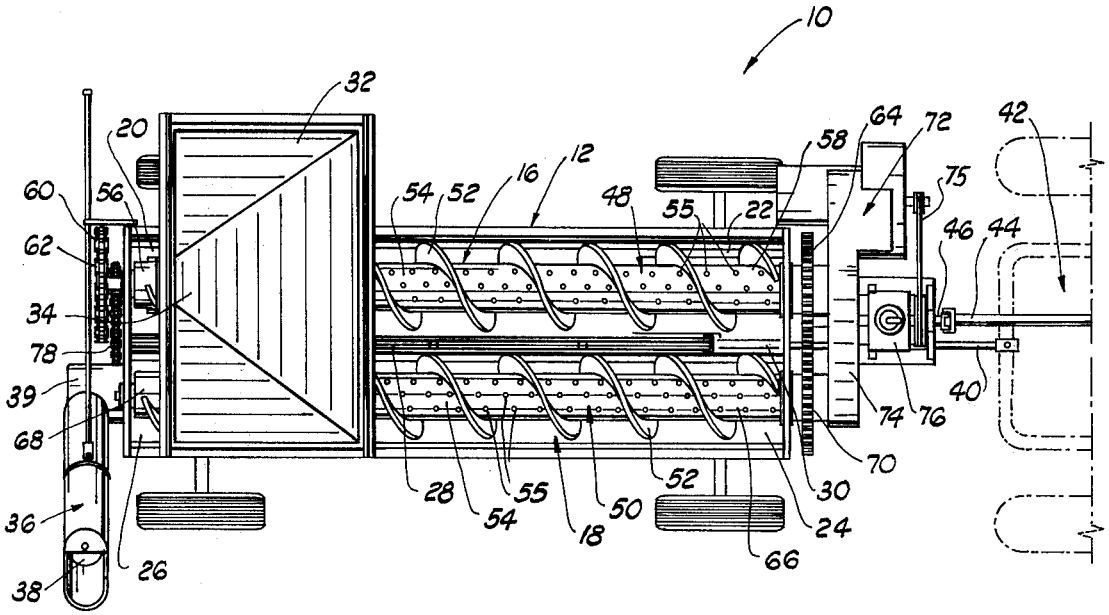
FIG. 2 is a top view of the grain drier.

In FIG. 2 a top view of the grain drier 10 is shown. In this view a first auger 48 and a second auger 50 can be seen mounted in the first chamber 16 and second chamber 18. The augers 48 and 50 include auger flights 52 spirally wound around hollow auger shafts 54. The hollow auger shafts 54 include perforations 55 through the sides of the shafts 54.

The first auger 48 includes a first end portion 56 and a second end portion 58. The first end portion 56 of the first auger 48 includes a chain sprocket 60 having an endless chain 62 mounted on the drive shaft 46 for rotating the first auger 48 in the first chamber 16. Attached to the second end portion 58 of the first auger 48 is a drive gear 64.

The second auger 50 includes a first end portion 66 and a second end portion 68. The first end portion 66 of the second auger 50 includes a driven gear 70 mounted thereon and meshing with the drive gear 64 for rotating the second auger 50.

A gas fired blower 72 using propane, butane or any similar combustible fluid is mounted on the housing 12 and vented by a vent housing 74 to the second end portion 58 of the first auger 48 and the first end portion 66 of the second auger 50. The blower 72 is driven by a drive belt 75 attached to the drive shaft 46.

In operation the power takeoff system 44 of the towing vehicle 42 is attached to the drive shaft 46 of the drier 10. The drive shaft 46 is attached to a transmission 76 which is used to adjust the speed of the augers 48 and 50. The drive shaft 46 drives the endless chain 62 thereby driving the chain sprocket 60 and rotating the first auger 48 in the first chamber 16. As the auger 48 rotates, the grain to be dried is discharged from the grain hopper 32 through the outlet 34 into the first end portion 20 of the first chamber 16. The auger flights 52 convey the grain along the elongated length of the first chamber 16 until the grain reaches the second end portion 22 of the first chamber 12. At this point the grain is fed through the opening 30 and down into the first end portion 24 of the second chamber 18. The drive gear 64 attached to the first auger 48 drives the driven gear 70 of the second auger 50 in an opposite direction and therefore the grain received into the second chamber 18 is conveyed in an opposite direction as received from the first chamber 16. The flights 52 of the second auger 50 convey the grain from the first end portion 24 to the second end portion 26 of the second chamber 18 and into the transfer chamber 39 of the transfer tube 36. As the grain is conveyed along the length of the chambers 16 and 18, the hollow shafts 54 receive the hot air from the blower 72. The hot air presses through the perforations 55 and into the grain as it is being conveyed. The transfer tube auger 38 is chain driven by the drive shaft 46 and is connected to the drive shaft 46 by an endless chain 78. As the grain is received into the transfer chamber 39 of the transfer tube 36 the transfer tube auger 38 moves the grain up through the tube 36 and discharges it therefrom.

Figure 3:
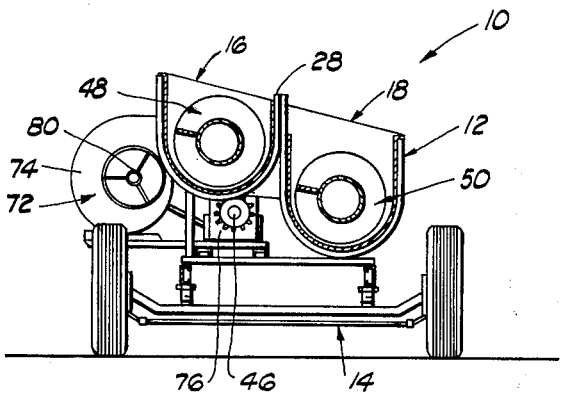
FIG. 3 is a sectional view of the drier taken along lines 3—3 shown in FIG. 1.

In FIG. 3 a sectional view of the drier 10 is seen taken along lines 3—3 shown in FIG. 1. In this view the first auger 48 and second auger 50 can be seen mounted in the lower portion of the first chamber 16 and second chamber 18, with divider 28 disposed between the chambers. It should be noted that both the first and second chambers 16 and 18 are open at the top for ease of maintenance and for removing any foreign objects that may be trapped between the augers and the sides of the chambers.

In this view an end view of the blower 72 can be seen having a blower fan 80 communicating with the vent housing 74. Also an end view of the drive shaft 46 is seen disposed below the first chamber 16 and attached at one end to the transmission 76.

Figure 4:
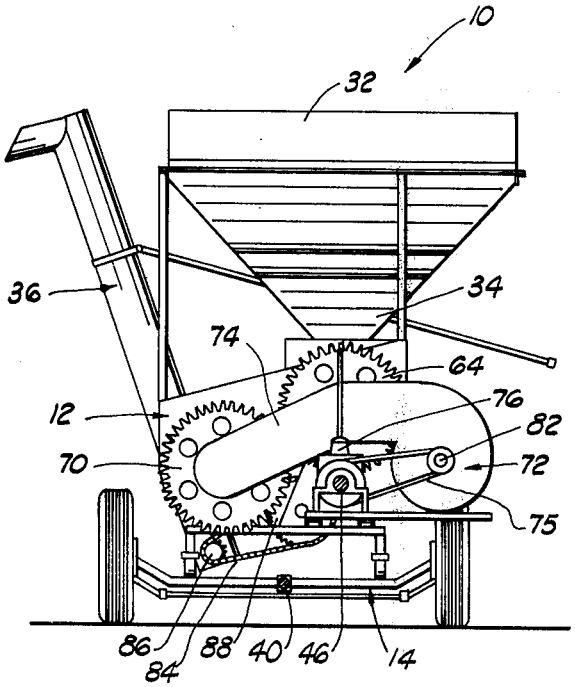
FIG. 4 is a front view of the grain drier.
Figure 9:
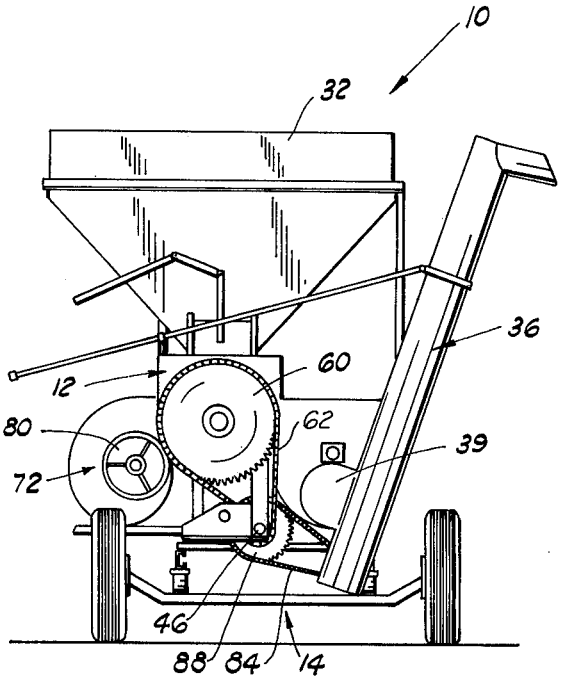

In FIG. 4 a front view of the drier 10 is seen. In this view the shaft 82 of the blower fan 80 shown in FIG. 3 is seen attached to the drive shaft 46 by the drive belt 75. Also seen in this view is an endless chain 84 attached to a chain sprocket 86 mounted to the end of the transfer tube auger 38. The chain 84 is driven by a drive chain sprocket 88 attached to the drive shaft 46.

FIG. 5 is a rear view of the drier 10. In this view the transfer tube 36 is seen attached to housing 12 and including transfer chamber 39 communicably connected to the second end portion 68 of the second chamber 18. The drive shaft 46 can be seen rotatably attached to the drive sprocket 88 having chain 84 mounted thereon and connected to the sprocket 86 for driving the auger 38 inside the transfer tube 36. Also connected to the drive shaft 46 is the endless chain 62 attached to chain sprocket 60 for driving the first auger 48.

Figure 6:
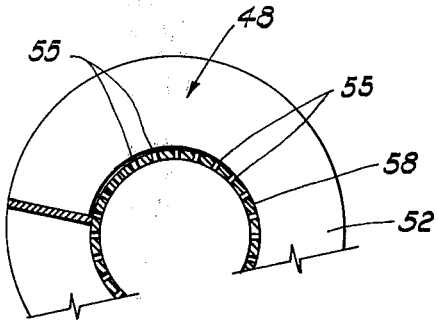
FIG. 6 is a sectional view of an auger used in the grain drier.

In FIG. 6 a sectional end view of the first auger 48 is seen showing the hollow shaft 58 with auger flights 52 mounted thereon. Also shown are the perforations 55 through the hollow shaft 58 for receiving the hot air from the blower 72 and discharging it around the outer circumference of the hollow shaft 58 and drying the grain as it is conveyed along the length of the first chamber 16.

Figure 7:
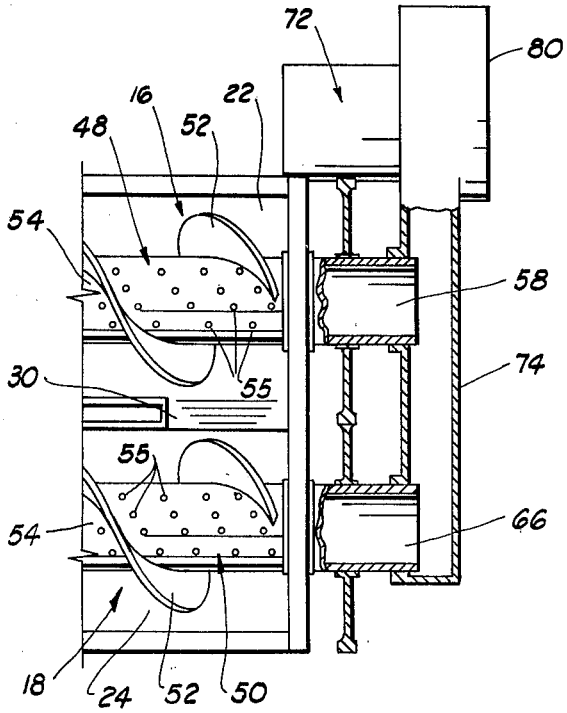
FIG. 7 is a partial sectional view of the blower and augers.

In FIG. 7 a partial view of the second end portion 22 of the first chamber 16 and the second end portion 24 of the second chamber 18 is shown. In this view the blower 72 can be seen having the vent housing 74 communicating with the second end portion 58 of the first auger 48 and the first end portion 66 of the second auger 50. The heated air is discharged into the vent housing 74 and into the hollow shafts 54. From the hollow shafts 54 the hot air is discharged out the perforations 55 along the length of the first and second augers 48 and 50.

Figure 8:
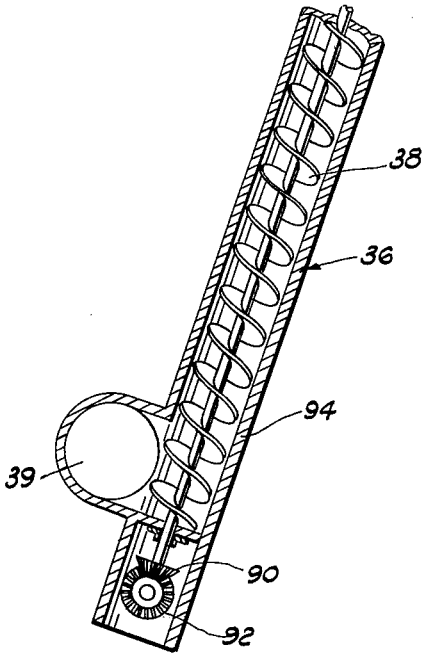
FIG. 8 is a sectional view of the transfer tube and transfer tube auger.

In FIG. 8 a cross sectional view of the transfer tube 36 is shown with the transfer tube auger 38 mounted therein. The transfer tube auger 38 includes a beveled gear 90 mounted at its lower end and meshing with a beveled gear 92 attached to the chain sprocket 86 shown in FIG. 4. Integrally formed in a lower portion 94 of the transfer tube 36 is the transfer chamber 39 which is communicably connected to the second end portion 26 of the second chamber 18 for receiving the dried grain.

Changes may be made in the construction and arrangement of the parts or elements of the embodiments as disclosed herein without departing from the spirit or scope of the invention as defined in the following claims.

I claim:

1. A grain drier for drying grain, the drier comprising:

an elongated drier housing;

a first elongated horizontal cylindrical chamber formed in said housing, said first chamber having a first end portion and a second end portion;

a second elongated horizontal cylindrical chamber formed in said housing, said second chamber having a first end portion and a second end portion, said second chamber adjacently disposed below and parallel to said first chamber, the first end portion of said second chamber communicating through an opening with the second end portion of said first chamber;

a first auger having a hollow shaft with perforations therein, said first auger horizontally mounted in said first chamber;

a second auger having a hollow shaft with perforations therein, said second auger horizontally mounted in said second chamber;

drive means attached to said first and second auger for rotating said augers in said chambers; and blower means communicating with the hollow shafts of said augers for blowing hot air into said hollow shafts and out the perforations therein for drying said grain, the grain to be dried is received at the first end portion of said first chamber and conveyed by said first auger to the second end portion of said first chamber, said first auger feeding the grain from the second end portion of said first chamber into the first end portion of said second chamber, said second auger conveying the grain from the first end portion of said second chamber to the second end portion of said second chamber and discharging the grain from said housing.

2. The drier as described in claim 1 further including storage means communicating with the first end portion of said first chamber for feeding grain to be dried thereto.

3. The drier as described in claim 2, wherein said storage means is a grain hopper mounted on said housing and disposed above the first end portion of said first chamber.

4. The drier as described in claim 1 further including a transfer tube pivotally attached to said housing and communicating with the second end portion of said second chamber for receiving the dried grain conveyed therefrom, said transfer tube having a transfer tube auger mounted therein for conveying the dried grain through said transfer tube.

5. The drier as described in claim 1 further including a wheeled vehicle frame for mounting the drier housing thereon.

6. The drier as described in claim 1, wherein said blower means is a gas fired blower mounted on said drier housing, said blower communicating with the hollow shafts of said augers.

7. The drier as described in claim 5, wherein said drive means includes a drive gear rotatably mounted to one end of said first auger and a driven gear rotatably mounted to one end of said second auger, said gears driven by a chain drive attached to the other end of said first auger, said chain drive attached to a drive shaft mounted to said housing.

8. The drier as described in claim 7 further including a transmission mounted on said housing and rotatably attached to said drive shaft for regulating the speed of said drive shaft in driving said first and second augers.

9. A grain drier for drying grain, the drier comprising:

an elongated drier housing;

a wheeled vehicle frame for mounting said drier housing thereon;

a first elongated horizontal cylindrical chamber formed in said housing, said first chamber having a first end portion and a second end portion;

a second elongated horizontal cylindrical chamber formed in said housing, said second chamber having a first end portion and a second end portion, said second chamber adjacently disposed below and parallel to said first chamber, the first end portion of said second chamber communicating through an opening with the second end portion of said first chamber;

a first auger having a hollow shaft with perforations therein, said first auger horizontally mounted in said first chamber;

a second auger having a hollow shaft with perforations therein, said second auger horizontally mounted in said second chamber;

a drive gear rotatably mounted on one end of said first auger, said drive gear meshing with a driven gear rotatably mounted on one end of said second auger, said gears driven by a drive shaft attached to said housing;

a blower mounted on said drier housing, said blower communicating with the hollow shaft of said augers;

a grain hopper mounted on said housing and disposed above the first end portion of said first chamber for feeding grain to be dried into said first chamber; and a transfer tube attached to said housing and communicating with the second end portion of said second chamber for receiving the dried grain conveyed therefrom, said transfer tube having a transfer tube auger mounted therein for conveying the dried grain through said transfer tube; the grain to be dried received at the first end portion of said first chamber from said grain hopper and conveyed by said first auger to the second end portion of said first chamber, said first auger feeding the grain from the second end portion of said first chamber into the first end portion of said second chamber, said second auger feeding the grain from the first end portion of said second chamber to the second end portion of said second chamber and discharging the grain into said transfer tube.

10. The drier as described in claim 9, wherein said drive shaft is rotatably attached to a power takeoff system of a farm vehicle used to tow the grain drier.

11. The drier as described in claim 9, wherein said transfer tube auger is rotatably attached to said drive shaft.

12. The drier as described in claim 9, wherein said blower is rotatably attached to said drive shaft.

* * * * *